US007260891B2

(12) United States Patent
Padula

(10) Patent No.: US 7,260,891 B2
(45) Date of Patent: Aug. 28, 2007

(54) CONNECTOR OVERMOLD SPACER

(75) Inventor: Santo Padula, Williamsburg, VA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 11 days.

(21) Appl. No.: 11/167,336

(22) Filed: Jun. 27, 2005

(65) Prior Publication Data

US 2006/0154516 A1 Jul. 13, 2006

Related U.S. Application Data

(60) Provisional application No. 60/643,682, filed on Jan. 13, 2005.

(51) Int. Cl.
*H01R 43/00* (2006.01)

(52) U.S. Cl. ..... 29/858; 29/857

(58) Field of Classification Search ..... 29/857, 29/858

See application file for complete search history.

(56) References Cited

U.S. PATENT DOCUMENTS

| | | | | |
|---|---|---|---|---|
| 4,032,214 | A * | 6/1977 | McNerney | 439/606 |
| 4,110,550 | A * | 8/1978 | Di Pietro | 174/19 |
| 4,582,384 | A | 4/1986 | Frantz et al. | |
| 4,961,713 | A * | 10/1990 | McCracken et al. | 439/587 |
| 5,279,030 | A * | 1/1994 | Ito et al. | 29/883 |
| 5,571,032 | A * | 11/1996 | Sano et al. | 439/589 |
| 6,428,357 | B1 | 8/2002 | Dolinshek et al. | |
| 6,482,021 | B2 * | 11/2002 | Hara et al. | 439/279 |
| 7,124,506 | B2 * | 10/2006 | Yamanashi et al. | 29/876 |
| 2003/0224649 | A1 | 12/2003 | Vista, Jr. et al. | |

* cited by examiner

*Primary Examiner*—Carl J. Arbes

(57) ABSTRACT

A connector assembly includes a terminal crimped to an electrical conductor. The terminal is retained in a terminal area of a connector housing. A cable seal is positioned within an opening of the connector housing that leads to the terminal area. A spacer at a rear side of the connector housing provides a mechanical barrier to prevent injected thermoplastics from entering the terminal area during an overmolding process.

12 Claims, 3 Drawing Sheets

CONNECTOR OVERMOLD SPACER

This application claims priority to U.S. Provisional Patent Application Ser. No. 60/643,682 filed Jan. 13, 2005.

BACKGROUND OF THE INVENTION

This invention generally relates to an electrical connector assembly, and more particularly to an electrical connector assembly that includes a spacer that provides a mechanical barrier to an injected thermoplastic or rubber material.

Connector assemblies are utilized to provide an electrical connection to various electronic devices found throughout a vehicle. Typically, a connector assembly and a cable jacket that houses electrical conductors are overmolded in thermoplastic or rubber by an injection mold to provide a barrier against moisture ingress. The connector assembly is assembled by crimping a pair of terminals onto the electrical conductors. The electrical conductors (including the crimped terminals) are then inserted into a plastic housing. Cable seals provide a moisture seal between the housing and the electrical conductors. The connector assembly is placed into an injection mold where a thermoplastic or rubber material is injected around and over the housing to complete the overmolded connector assembly.

The pressures during the overmolding process can be overpowering such that an amount of the thermoplastic or rubber material passes by the cable seals and enters the housing. Disadvantageously, thermoplastic or rubber material that passes through the cable seals and enters the terminal area may interfere with proper connection and function of the connector assembly.

Accordingly, it is desirable to provide an improved electrical connector assembly that is easy to assemble and that blocks injected thermoplastic or rubber material from interfering with terminal connections.

SUMMARY OF THE INVENTION

An electrical connector assembly according to the present invention provides a terminal area with a mechanical barrier to injected thermoplastics during an overmolding process.

The connector assembly includes an electrical conductor with a terminal crimped to the electrical conductor. The terminal is inserted into a terminal area of a connector housing and snapped into place by a cantilever arm. A spacer is positioned at a rear side of the connector housing. The connector assembly is placed into a mold and overmolded with an injected thermoplastic.

In one example, the spacer is split along its length to comprise a first half piece and a second half piece. The first half piece and the second half piece of the spacer seal the terminal area of the connector assembly from the injected thermoplastic.

The electrical connector assembly of the present invention is easy to assembly and provides a mechanical barrier to injected thermoplastics during an overmolding process.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
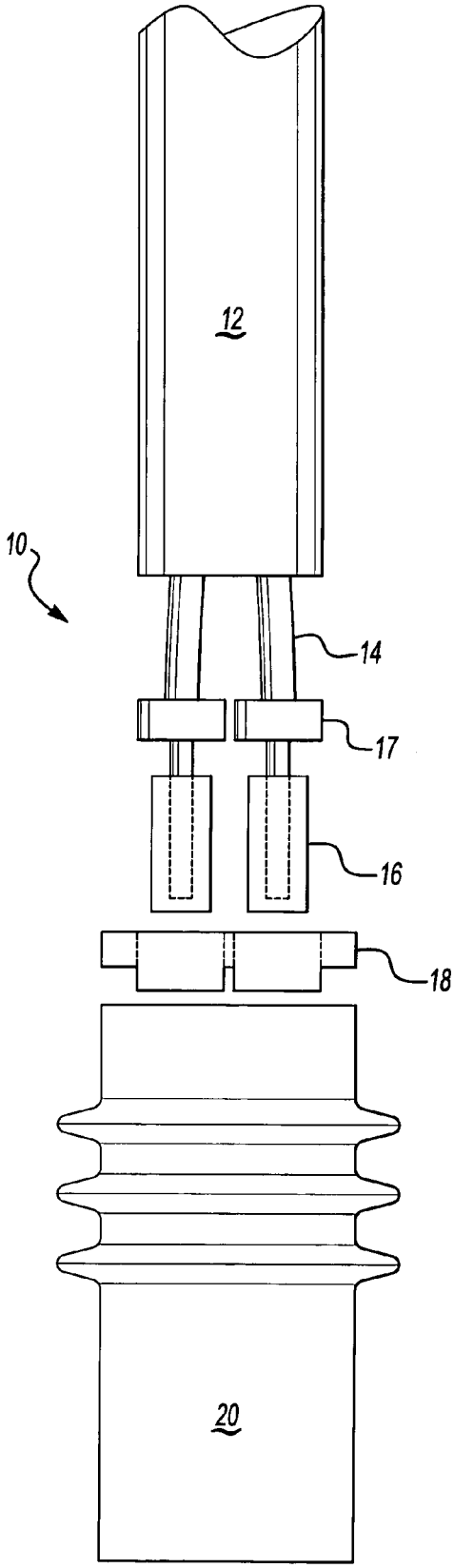
FIG. 1 is an exploded view of a connector assembly according to the present invention.
Figure 2:
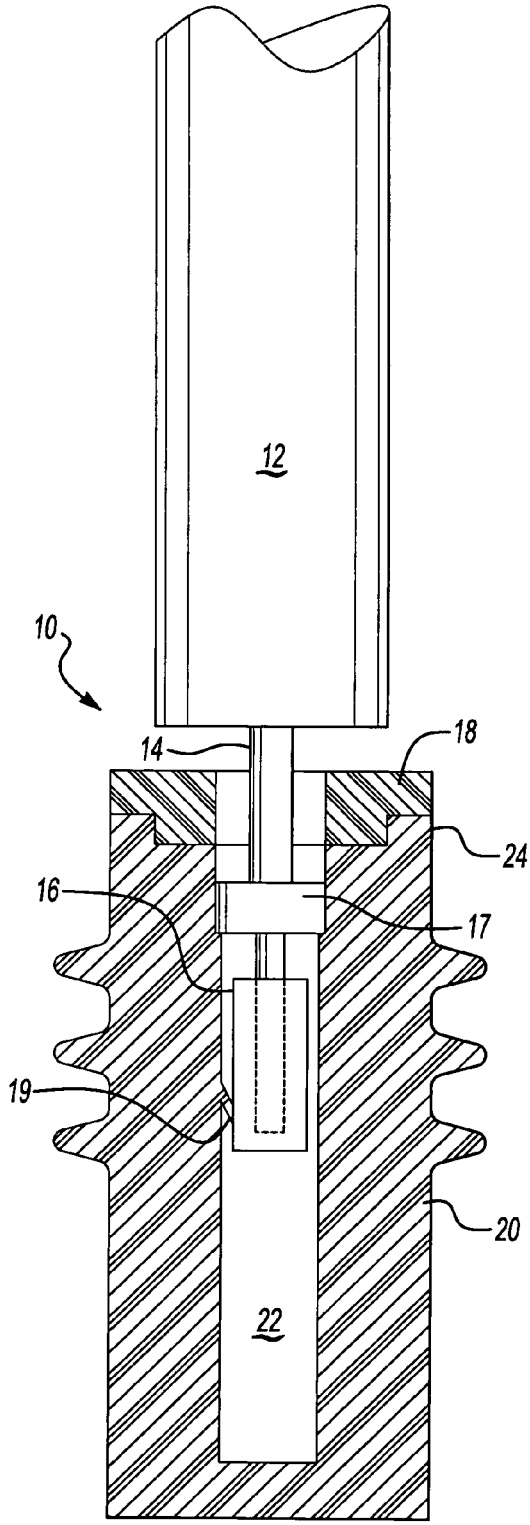
FIG. 2 is a cross sectional view of the connector assembly of the present invention.

Referring to FIGS. 1 and 2, a connector assembly 10 includes a cable jacket 12 that includes a plurality of electrical conductors 14 (two electrical conductors 14 are shown in FIG. 1). The example cable jacket 12 is made of a thermoplastic, however other materials may be used as are known. The electrical conductors 14 are preferably insulated wires that conduct an electrical current. A terminal 16 is crimped to the end of each of the electrical conductors 14. A cable seal 17 is positioned around each of the electrical conductors 14.

A spacer 18 is positioned around the electrical conductors 14 after the terminals 16 are crimped to the electrical conductors 14. The terminals 16 are inserted into openings in a connector housing 20. The connector housing 20 includes a cantilever arm 19 to retain the terminals 16 within a terminal area 22 of the connector housing 20. The cantilever arm 19 provides a snap-fit between the terminals 16 and the connector housing 20. The cable seals 17 are inserted into the openings within the connector housing 20 that lead to the terminal area 22 and form a moisture seal between the connector housing 20 and the terminals 16. Once the terminals 16 and the cable seals 17 are inserted into the connector housing 20, the spacer 18 is positioned at a rear side 24 of the connector housing 20 to form the connector assembly 10. The spacer 18 is prevented from being pressed into the openings of the connector housing 20 because of a slight interference fit between the spacer 18 and the inner diameter of the connector housing 20, as is further discussed below.

Figure 3:
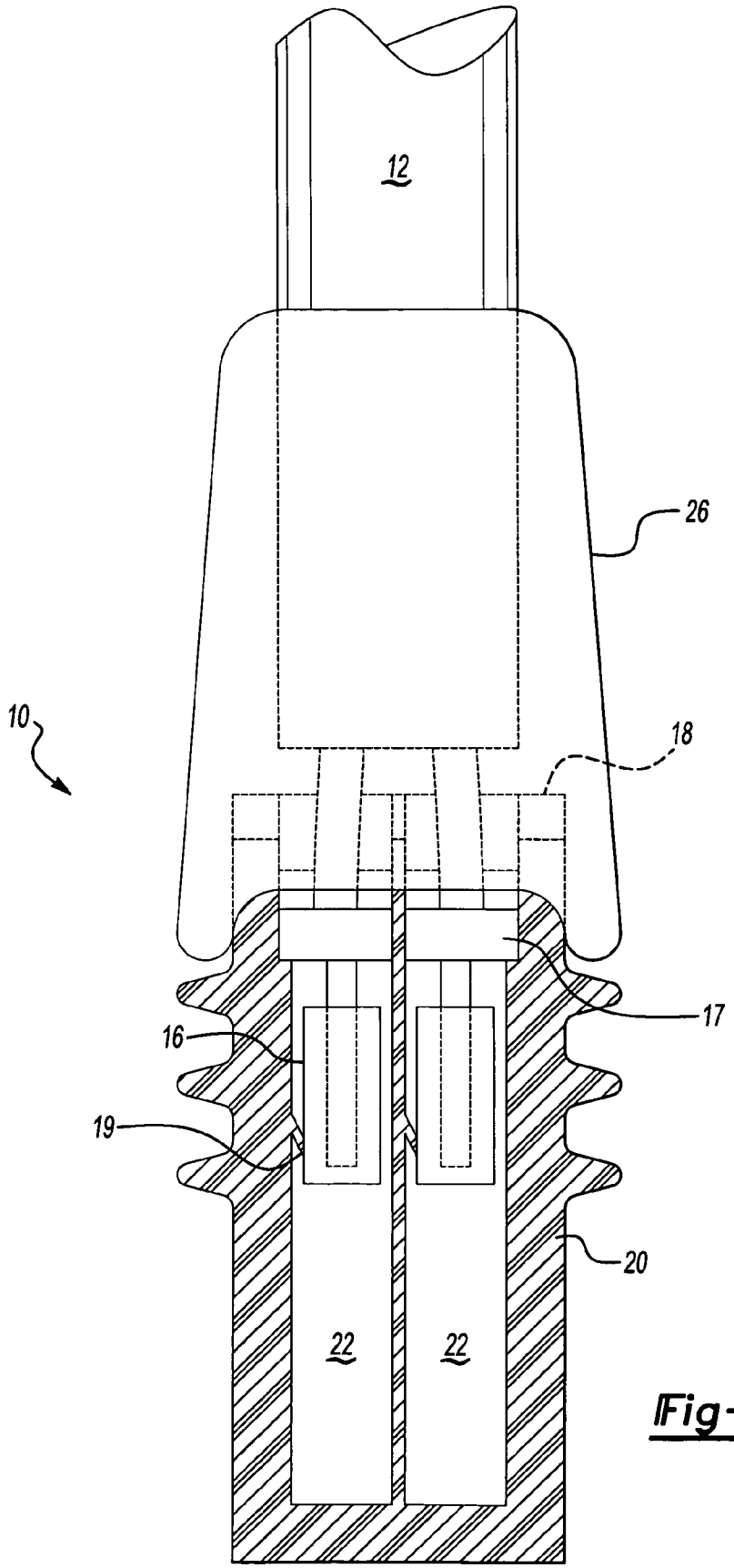
FIG. 3 is a partial cut away view of an overmolded connector assembly of the present invention.

Referring to FIG. 3, the connector assembly 10 includes an overmold boot 26. The overmold boot 26 is formed during an injection molding process in which a material, such as rubber, is injected into a mold. The overmold boot 26 encases at least a portion of the cable jacket 12 and the connector housing 20 and prevents water intrusion within the connector housing 20 of the connector assembly 10. The spacer 18 seals the terminal area 22 of the connector housing 20 from intrusion of material during the overmolding process. A desired connection between the terminals 16 and the terminal area 22 is achieved for proper connection and function of the connector assembly 10.

Figure 4:
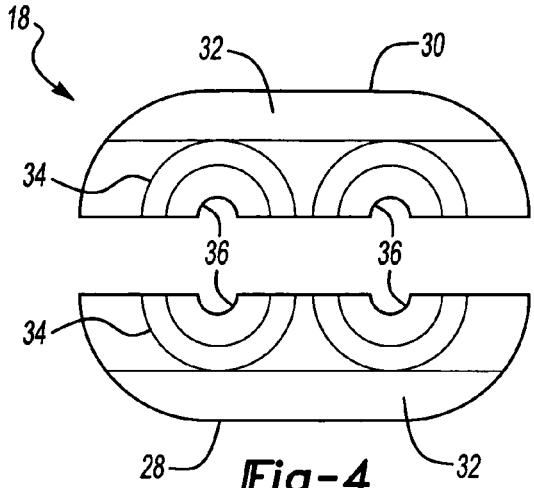
FIG. 4 is a plan view of a spacer of the connector assembly of the present invention.
Figure 5:
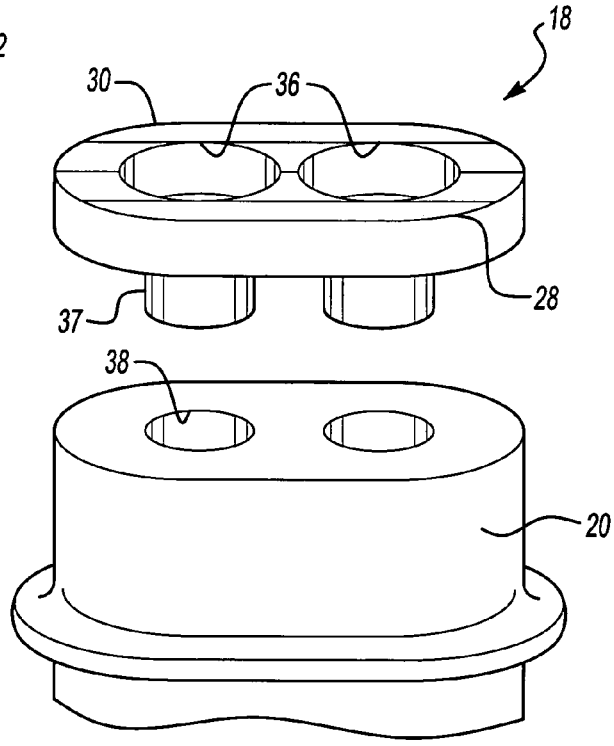
FIG. 5 is a perspective view of the spacer of the present invention interfaced with a connector.

Referring to FIGS. 4 and 5, and with continuing reference to FIGS. 1, 2 and 3, an example of the spacer 18 is shown and is a pre-molded plastic part. The spacer 18 is split along a length to include a first piece 28 and a second piece 30. The two piece configuration of the spacer 18 provides for ease of assembly around the electrical conductors 14. Each of the pieces 28 and 30 of the spacer 18 include a flange portion 32 and at least one half cylinder 34 (two are illustrated in FIG. 4) transversely protruding from the flange portion 32. The example flange portion 32 is generally crescent shaped. However, the shape of the flange portion 32 can be of any shape to correspond to the connector housing 20.

The first piece 28 and the second piece 30 of the spacer 18 are placed against each other around the electrical conductors 14. The cylinders 34 of the first piece 28 and the second piece 30 combine to define tubular grooves 36 for receiving the electric conductors 14. The inner diameters of the tubular grooves 36 are sized to achieve a press fit between the spacer 18 and the electrical conductors 14.

Each of the half cylinders 34 of the first piece 28 and the second piece 30 of the spacer 18 combine to form a protruding tube 37 (two are shown in FIG. 5). The protruding tubes 37 provide an interference fit with openings 38 within the connector housing 20 such that the flange portions 32 of the spacer 18 contact the outer diameter of the connector housing 20 and the protruding tubes 37 at least partially enter the openings 38 within the connector housing 20 (See FIG. 2). Retention of the interference fit between the spacer 18 and the connector housing 20 is aided by the compression of the electrical conductors 14 within the tubular grooves 36 of the spacer 18.

Figure 6:
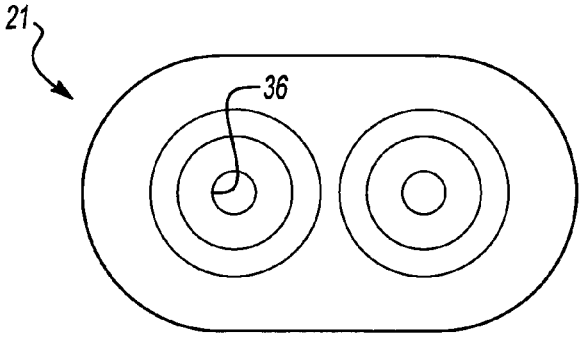
FIG. 6 is another example of the spacer of the electrical connector assembly of the present invention.

Another example spacer 21 is illustrated with reference to FIG. 6. The spacer 21 in this example is nearly identical to the spacer 18 shown in FIG. 2. In this example, however, the spacer 21 is a single piece. During assembly of the connector assembly 10, the spacer 21 in this example is positioned around the electrical conductors 14 before the terminals 16 are crimped to the electrical conductors 14.

That the foregoing description shall be interpreted as illustrative and not in a limiting sense is thus made apparent. A worker of ordinary skill in the art would recognize that certain modifications would come within the scope of this invention. For that reason, the following claims should be studied to determine the true scope and content of this invention.

What is claimed is:

1. A method of fabricating a connector assembly comprising the steps of:

(a) attaching a terminal to an electrical conductor;

(b) positioning a seal and a spacer around the electrical conductor;

(c) inserting the terminal into a terminal area of a connector housing and positioning the spacer near a rear side of the connector housing;

(d) overmolding at least a portion of the electrical conductor and the connector housing with a thermoplastic material; and (e) sealing the terminal area against intrusion of the thermoplastic material.

2. The method as recited in claim 1, wherein said step (a) comprises:

crimping the terminal to the electrical conductor.

3. The method as recited in claim 1, wherein, said step (b) comprises:

positioning a first piece and a second piece of the spacer around the electrical conductor.

4. The method as recited in claim 1, wherein said step (c) comprises:

inserting the seal at least partially within an opening that leads to the terminal area of the connector housing.

5. The method as recited in claim 1, wherein said step (d) comprises:

inserting the connector assembly into a mold and injecting the thermoplastic material into the mold.

6. The method as recited in claim 1, wherein said step (b) and said step (c) are performed prior to said step (d).

7. A method of sealing a housing of a connector assembly, comprising:

(a) positioning a first spacer piece around an electrical conductor;

(b) positioning a second spacer piece around the electrical conductor;

(c) inserting a seal at least partially within the housing;

(d) sliding the first spacer piece and the second spacer piece near a rear side of the housing; and (e) sealing a terminal area of the housing against intrusion of a thermoplastic material.

8. The method as recited in claim 7, wherein said step (a) comprises:

attaching a terminal to the electrical conductor.

9. The method as recited in claim 8, wherein said step (c) comprises:

inserting the terminal into the terminal area of the housing.

10. The method as recited in claim 8, wherein said step (e) comprises:

inserting the connector assembly into a mold and injecting the thermoplastic material into the mold.

11. The method as recited in claim 10, wherein said step (e) comprises:

overmolding at least a portion of the housing with the thermoplastic material.

12. The method as recited in claim 7, wherein said steps (a) through (d) are performed prior to said step (e).

* * * * *